United States Patent [19]

Hoffmann et al.

[11] Patent Number: 4,822,463

[45] Date of Patent: Apr. 18, 1989

[54] PROCESS FOR THE ELECTROPHORETIC FORMATION OF SELFCLEANING ENAMEL FREE FROM ALUMINUM ON STEEL SHEET PARTS

[75] Inventors: Hans Hoffmann, Leichlingen; Bruno Hees, Langenfeld, both of Fed. Rep. of Germany

[73] Assignee: Bayer Aktiengesellschaft, Fed. Rep. of Germany

[21] Appl. No.: 74,385

[22] Filed: Jul. 16, 1987

[30] Foreign Application Priority Data

Aug. 5, 1986 [DE] Fed. Rep. of Germany ..... 3626424

[51] Int. Cl.[4] ..... C25D 13/02

[52] U.S. Cl. ..... 204/181.1

[58] Field of Search ..... 204/181.1

[56] References Cited

U.S. PATENT DOCUMENTS

| | | | |
|---|---|---|---|
| 3,935,088 | 1/1976 | Kaup | 204/181 |
| 4,361,660 | 11/1982 | Streitberger | 523/404 |
| 4,576,868 | 3/1986 | Poth | 428/423.1 |

FOREIGN PATENT DOCUMENTS

| | | |
|---|---|---|
| 0036558 | 3/1981 | European Pat. Off. . |
| 2917710 | 11/1980 | Fed. Rep. of Germany . |

*Primary Examiner*—John F. Niebling
*Assistant Examiner*—Isabelle Rodriguez
*Attorney, Agent, or Firm*—Sprung Horn Kramer & Woods

[57] ABSTRACT

A process for the electrophoretic application of self-cleaning enamel systems free form aluminium on sheet steel by the two layered/single stoving process, comprising applying a base layer in a thickness of 80 to 120 μm to a steel substrate, and then applying a top coat to said base coat, said top comprising an enamel suspension having a specific conductivity adjusted to a value below 2000 $\mu S.cm^{-1}$.

3 Claims, No Drawings

PROCESS FOR THE ELECTROPHORETIC FORMATION OF SELFCLEANING ENAMEL FREE FROM ALUMINUM ON STEEL SHEET PARTS

BACKGROUND OF THE INVENTION

Field of the Invention

This invention relates to an improved process for the electrophoretic deposition of self-cleaning enamel layers in which a layer of base enamel is first deposited on the steel sheet part and the top layer of enamel is then applied and the two layers are stoved together.

Background Information

The application of enamel by electrodip enamelling (electrophoresis, the so called "ETE" process) is known. Production plants of various kinds, primarily for domestic appliances, have been described in the literature (see e.g. Warnke, F. Kaup, Maschinenmarkt, 80 (1974), page 4 or H. Hoffmann, Mitteilungen des VDEFa, 24 (1976) page 13 and 29 (1981) page 107). Electrodip enamelling is usually confined to the application of a single layer since it presupposes a conductive metallic base.

Once an enamelling has been stoved it can no longer be covered by another layer or enamel by electrophoretic means.

In the course of application of the enamel, the deposited layer is strengthened by electroosmosis so that any loosely adhering particles may be washed off and under certain conditions, e.g., if the deposit is firm enough and if the products have suitable melting properties and interface reactions, it is possible to apply another layer to this base layer. In product combinations in which both systems have suitable properties for electrodip coating, this second layer may also be deposited electrophoretically.

This procedure is, however, relatively susceptible to trouble and with the processes nowadays employed it is frequently found that enamelling faults occur (surface blistering due to faults in the electrolytic process, and uneven coating even to the point of the whole layer being lifted off by gas bubbles.

SUMMARY OF THE INVENTION

It has now surprisingly been found that the disadvantages mentioned above can be prevented by observing certain conditions in the formation of the enamel layers. Thus it has been shown, for example, that a much better quality of enamel in the finished product can be obtained if the electrophoretic base coat to which the continuously self-cleaning system is subsequently applied has a thickness of about 80 to 120 μm. This is all the more surprising since the base coat in such a two layered/single stoved enamelling hitherto had to be applied much more thinly (about 20 to 40 μm) if a top coat enamelling with good surface quality was to be obtained.

It has also been found that much more uniform coatings with less defects could be obtained by adjusting the specific conductivity of the suspension for the top enamelling coat to a value not exceeding 2000 $\mu S.cm^{-1}$. In the ETE processes hitherto known, sufficiently uniform deposition could only be obtained with enamel slip conductivities of about 2500 to 3000 $\mu S.cm^{-1}$.

The present invention therefore relates to the electrophoretic formation of continuously self-cleaning systems on sheet steel by the two layered/single stoving process, characterized in that the base layer is applied in a thickness of from 80 to 120 μm and the specific conductivity for deposition of the suspension of top coat enamel is adjusted to less than 2000 $\mu S.cm^{-1}$.

DETAILED DESCRIPTION OF THE THE INVENTION

The process according to the invention is preferably employed for the manufacture of continuously self-cleaning internal parts of stoves. The base layer preferably consists of an acid resistant direct enamel.

The method employing thicker base layers provides the additional technical advantage that application of the self-cleaning enamel by the two-layered single-stoving process and application of standard base coats or differently colored acid resistant coats by direct enamelling can easily be carried out in one and the same installation. For example, 70% of the parts may be treated with only one application and the stoved, while the remaining 30 of the parts may be transferred directly from the first coating station to the second coating tank.

Any known base enamel or special enamel suitable for the electrodip coating process in which the slip has a specific conductivity not exceeding 2000 $\mu S.cm^{-1}$ after grinding and before addition of the sodium aluminate may be used as a starting material for the first layer.

Any known systems with self-cleaning properties free from aluminium may be used as second layers.

The following is a general outline of the process according to the invention:

Parts of sheet steel suitable for enamelling are first degreased by chemical and/or electrolytic methods, possibly assisted with ultrasound and then washed with H2O, activated in acid solution, again washed and thereafter coated electrophoretically with a base layer in the first application tank (coating time about 7–8 seconds).

After another careful washing, the self-cleaning layer is built-up electrophoretically in a second application tank (exposure time about 15 seconds). Loosely adhering particles which have not been deposited electrophoretically are then rinsed off and the enamel is stoved (810°–840° C., dwell time about 2.5 to 4 minutes). The exact stoving conditions depend on the thickness of the sheet metal, the particular enamel chosen and the weight of the parts.

It will be appreciated that the instant specification and claims are set forth by way of illustration and not limitation, and that various modifications and changes may be made without departing from the spirit and scope of the present invention.

What is claimed is:

1. A process for the electrophoretic application of self-cleaning enamel systems free from aluminium on a sheet steel by a two layered/single stoving process, comprising applying a base layer in a thickness of 80 to 120 μm to a steel substrate, and then applying a top coat to said base coat, said top coat comprising an enamel suspension having a specific conductivity adjusted to a value below 2000 $\mu S.cm^{-1}$.

2. A process according to claim 1, wherein the base coat comprises differently colored acid resistant direct enamel combinations.

3. A process according to claim 1, wherein the base layer comprises an acid resistant direct enamel.

* * * * *